United States Patent [19]

Weihrauch

[11] Patent Number: 4,849,271

[45] Date of Patent: Jul. 18, 1989

[54] PROCESS FOR PRODUCING MATS FOR CLEANING PURPOSES AND MAT FOR CLEANING PURPOSES

[75] Inventor: Georg Weihrauch, Wald-Michelbach, Fed. Rep. of Germany

[73] Assignee: Coronet-Werke Heinrich Schlerf GmbH, Wald-Michelbach, Fed. Rep. of Germany

[21] Appl. No.: 138,452

[22] PCT Filed: Nov. 7, 1986

[86] PCT No.: PCT/EP86/00643

§ 371 Date: Dec. 3, 1987

§ 102(e) Date: Dec. 3, 1987

[51] Int. Cl.[4] ..... B32B 3/02

[52] U.S. Cl. ..... 428/88; 15/215; 15/216; 15/217; 156/72; 428/89; 428/95

[58] Field of Search ..... 15/215, 216, 217; 428/85, 88, 89, 95, 92; 156/72

[56] References Cited

U.S. PATENT DOCUMENTS 4,353,944 10/1982 Tarui ..... 428/217

FOREIGN PATENT DOCUMENTS 2034089 1/1972 Fed. Rep. of Germany ..... 15/217

2034090 2/1972 Fed. Rep. of Germany ..... 15/217

*Primary Examiner*—Marion C. McCamish

*Attorney, Agent, or Firm*—Antonelli, Terry & Wands

[57] ABSTRACT

Mats for covering surfaces or for cleaning purposes, particularly doormats, which comprise a basic material, mainly of plastic with a fibrous layer and a support layer fixing the latter and fibres with a bristle-like structure applied to the basic material. The basic material is zonally melted by heating the fibres and optionally the support layer and compressed onto or into the support layer 50 as to form depressions in fibrous layer. The bristles are inserted substantially in parallel to each other in the in depressions and are joined to the compressed basic material by melting their ends or by a homogeneous weld.

24 Claims, 1 Drawing Sheet

PROCESS FOR PRODUCING MATS FOR CLEANING PURPOSES AND MAT FOR CLEANING PURPOSES

BACKGROUND OF THE INVENTION

The invention relates to a mat and a process for producing mats for covering surfaces or for cleaning purposes, particularly door mats, which are made from a basic material mainly constituted by plastic with a fibrous layer and a support layer fixing the latter and fibres applied to the basic material with a bristle-like structure.

Within the sense of the invention, the term mat is understood to mean any flat material in web form or in the form of blanks having a random size. From the use standpoint, this is understood to mean foot scrapers, door mats, rugs, soft mats or webs, belt brushes or other smaller blanks in the form of pads or the like. Mat material of this type is generally used for cleaning purposes, e.g. in the form of a doormat, foot scraper or rug for cleaning the shoes before entering rooms, or in the form of wall-to-wall carpeting for covering foyers, entrance halls and the like and in the form of belts, pads or the like for the mechanical or manual cleaning of surfaces, etc.

To the extent that the mats are used as doormats, rugs, etc., they used to be made from natural fibres, such as coir and sisal fibres and the like, while of late they have been produced from synthetic fibres, e.g. as needled felt. Such fibrous mats are intended to strip dirt from shoes and to retain the stripped off dirt within the fibrous structure. The tendency is towards artificial fibres, because they rot less rapidly, are more hygienic and dry faster in the case of the access of moisture. It has also been recognised that the cleaning action can be improved by replacing the fibrous material by bristles, which are upright and in parallel to one another. However, a disadvantage thereof is the inadequate retention of dirt, because the stripped off dirt particles spatter.

As has already been stated, the first-mentioned fibrous mats include simple needled felt mats, in which the needled or sewn tangled fibres are held on the back by compression, spraying or the application of a binder, accompanied by the formation of a support layer. This category also includes mats formed from pile fabric, e.g. of polypropylene, in which the pile weft or warp is cut up to form bristle-like fibres (German utility model 7 738 685).

A number of different constructions of mats with a bristle structure are also known. The bristles in the form of bristle strips are fixed mechanically either in ledge or box-like holders (DE-OS 2 347 790, German patent 2 530 974, DE-OS 2 555 125 and U.S. Pat. No. 2,805,437) or are fixed in support grids (DE-AS 1 003 930). The dropping of the stripped off dirt onto the floor is either accepted, or between individual bristle strips are provided adequately large chambers for trapping the dirt. It is also known to provide roller-like brushes in directly juxtaposed manner with interengaging bristles (DE-AS 1 931 548 and DE-AS 1 654 104). Such bristle mats ensure a relatively good dirt retention. However, all the aforementioned embodiments are technically complicated to manufacture and are therefore expensive.

In another group with a similar structure (German utility models 7 520 299 and 7 443 282), the support layer is formed by large-area plastic injectioin moulded parts with chamber-like depressions, bristles being engaged on the upper edge of the chambers bounding the webs. These constructions aim at ensuring that the dirt stripped off from the bristles is collected in the chamber. However, such doormats only function correctly if they are provided with a full-area, dense covering of bristles. From the manufacturing standpoint it is difficult, if not impossible, to apply the large number of bristles to the relatively small faces of the webs of the support material.

Knowing this, it has also been proposed (U.S. Pat. No. 3,886,620 and German utility model 6 909 246), to injection mould be entire doormat in one piece from plastic, so that the bristles are made from the same material as the support structure. Here again retention chambers for the dirt are provided. However, as is known, injection moulded bristles are relatively soft and for manufacturing reasons must have a relatively large diameter.

They must also taper conically in order to be able to permit removal from the injection mould. Quite apart from the fact that these doormats require a considerable manufacturing expenditure, they are not satisfactory from the use standpoint due to the soft bristles, because the latter bend down and do not right themselves again.

Another development is directed at fixing plastic bristles produced in the conventional way in the form of bundles to a fabric so as to constitute a support layer, in that the fixing end of the bristle bundles are melted and pressed onto the fabric, so that the melt penetrates the fabric structure. After cooling, the bristle bundle is located on the fabric support layer (DE-OS 2 335 468). These mats cannot withstand great stressing or loading, such as is the case with doormats or mechanically functioning means having brush belts or disks. In place of this, it is also known to melt the foot of the bristle bundles and to join the individual bundle feet by a lattice structure, around which foaming or injection moulding additionally takes place in order to obtain a full-area support web (DE-OS 2 109 972 and U.S. Pat. No. 3,798,699). Here again no adequate dirt retention is ensured as a result of the necessarily large distance between the individual bristle bundles. In addition, the foothold security is also inadequate in all known constructions with a large spacing of the bristle bundles or strips.

From the use standpoint, the aforementioned mat (German Pat. No. 2 034 089) is satisfactory. It comprises a basic material with a fibrous layer in the form of tangled fibres of relatively fine plastic fibres and a support layer fixing the same. This fibrous mat is provided with impressions for forming protective chambers, in that the fine plastic fibres are melted and compressed to a limited thickness. Coarser fibres in the form of loops or in bristle-like manner are sewn onto the unworked protuberances of the mat. Thus, this mat comprises the dirt-retaining chambers and on said protuberances is constituted by fine plastic fibres and bristle-like fibres. As a result of this fibre combination, a particularly good stripping action is obtained, without excessive dirt spattering, such as occurs with a bristle mat. As the mat is made exclusively from plastic fibres, it is also satisfactory from the hygienic standpoint. However, it is a disadvantage that the disordered bristles cannot produce the same brush action as in the case of pure bristle mats. As a result of their relatively large diameter, the bristle-like fibres can only be needled on or sewn with difficulty. As only a relatively small proportion of the bristles are perpendicular to the mat surface, they can easily be trodden down, so that they do not or do not satisfactorily fulfil their function.

The aim underlying the present invention essentially resides in providing a process for producing mats, which realises the advantageous effects of fibres and bristles, while such a mat can also be inexpensively manufactured.

On the basis of the aforementioned process, in which the mat comprises a basic material, mainly constituted by plastic with a fibrous layer and a support layer fixing the latter and fibres with a bristle-like structure applied to the basic material, according to the present invention the basic material is zonally melted by heating the fibres and optionally the support layer and is compressed onto or into the support layer, accompanied by the formation of depressions in the fibrous layer and that in the depressions are inserted bristles roughly in a parallel position and are joined by melting their ends to the compressed basic material.

Through the melting of the fibres and optionally the support layer and the then or subsequently occurring compression, in the vicinity of the depression is formed a stable base, mainly of plastic, in which are anchored the roughly parallel bristles by melting the ends thereof. This leads to a doormat in which the bristles are in a roughly vertical position which is important for their function, so that they can fulfil optimum stripping and cleaning requirements. These bristles also stand within uninfluenced fibrous material of the fibrous layer, so that the fibres are also able to fulfil their stripping and dirt retention function in a satisfactory manner in all respects. Moreover, through the melting of the bristle ends, the fibres and optionally the support layers, there is a firm union of all the components of the mat, so that a high life is ensured despite the considerable stressing suffered by doormats. This also applies to the actual bristles, which are not arranged individually and in free-standing manner so that they can easily be trodden down and are instead bound and supported within the fibrous structure, so that over at least a considerable proportion of their length, they are not exposed to marked bending and buckling forces.

Unlike in the case of conventional doormats, the supporting function is not merely fulfilled by the support layer of the basic material and in fact it is helped by the zonally present, reinforced base of the depressions which, as a function of their arrangement, can be punctiform, strip-like, lattice-like, etc.

The manufacturing costs for such a mat are relatively low compared with the known constructions, because the basic material produced in a conventional manner can be covered with bristles by a solely thermal method. These melting and optionally welding processes can be readily mechanically performed and can also be realised in mass-produced manner with a high output capacity.

In a preferred embodiment, the bristles are welded to the basic material. It is recommended to use bristles from the same plastic as the fibres of the basic material, or to use a plastic with a corresponding affinity.

According to another realisation of the inventive process, the melted ends of the bristles are compressed onto the basic material. This can take place in such a way that the melt at least partly penetrates between the fibres adjacent to the depression. In this variant, the fibres and bristles can be made from very differing materials. Practical tests have shown that, independently of the nature of the connection, it is even possible to use a proportion of natural fibres within the fibrous layer. Instead of this, it is also possible to press the melted fibres into the basic material melt, so as to permit a flow round the bristle melt, which also leads to a firm hold.

According to another process variant, in the edge area of the depression, the fibres of the basic material are melted over the height of the fibrous layer to form a type of wall. This leads to a type of blind hole, in which the bristles are inserted. The melted fibres form a lateral support for the bristles.

Using the inventive process, it is also possible to produce mats in the form of webs or in the form of surface-limited sections, so that all the aforementioned use possibilities for the material can be satisfied.

The invention also relates to a mat for covering surfaces or for cleaning purposes, particularly a doormat, which comprises a basic material mainly constituted by plastic with a fibrous layer and a support layer fixing the latter and fibres with a bristle-like structure applied to the basic material.

According to further developments of the invention, this known mat with a combined fibrous and bristle structure may be employed in such a way that the use advantages of both structures are fully obtained.

In the case of the aforementioned mat, this problem is inventively solved in that the basic material of the fibrous layer is zonally provided with depressions, whose bottom is formed by the melting of the fibrous layer and compression onto or into the optionally melted support layer and that into the depressions are inserted bristles roughly in parallel and they are fixed in the bottom of the depressions by the melting of their ends.

The mat zonally comprises a purely fibrous layer, whereas, in other regions it is formed from bristles which, as is generally the case with brushware, they are substantially perpendicular to the surface. In an unhindered manner, the fibres can perform their stripping and retention function for dirt, while to the same extent advantage is taken of the stronger stripping function of the bristles, especially with profiled surfaces. The diameter and length of the bristles, as well as of the material thereof can be chosen as a function of the specific requirements. The bristles can also be applied in a random geometrical arrangement to the mat. It is also possible to combine bristles with different characteristics and effects. It is also possible to use special bristles, e.g. with an abrasive filling for abrading and polishing purposes in the mat material.

According to an embodiment the bristles can be welded to the basic material at the bottom of the depression and can optionally have a widened foot on their ends inserted in the depression. Additionally said widened foot can extend to between the fibres of the fibrous layer adjacent to the depression and ensure an additional anchoring of the bristles there.

According to a further development of the invention, the depressions have wall-like reinforcements, which are formed by fibres melted over the height of the fibrous layer, which leads to an additional support and guidance of the bristles inserted in the depressions.

According to another embodiment, the cross-section assumed by the bristles is smaller than the cross-section of the depression. As a result, between the bristles and the fibrous layer is formed an all-round gap, which acts as a dirt retaining chamber.

Instead of this, the cross-section of the depression can also be smaller than that assumed by the bristles, so that there is a type of press fit of the bristles within the fibrous layer, so that the bristles are once again laterally supported.

The bristles can be inserted in individually standing manner, in bundles or in strips in correspondingly constructed depressions of the basic material. Here again the configuration is mainly a function of the intended use.

Finally, the bristles can project over the fibrous layer surface, can terminate flush therewith or can terminate below the surface. In the first and second cases the bristles act during any stripping process, whereas in the latter case they only evolve their action if a greater pressure is exerted on the fibrous layer during the stripping process and therefore the fibrous layer is correspondingly compressed.

The invention is described in greater detail hereinafter relative to embodiments and with reference to the attached drawings, wherein show:

DETAILED DESCRIPTION

Figure 1:
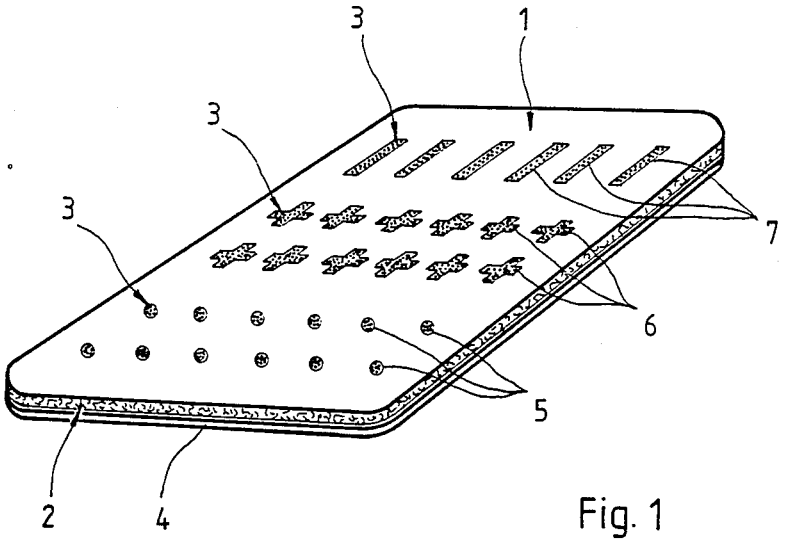
FIG. 1 is a perspective view of an embodiment of a mat constructed in accordance with the present invention fashioned as a doormat.
Figure 2:
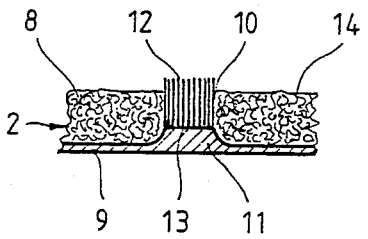
FIGS. 2–5 are cross-sectional detail views, on an enlarged scale of various embodiments of the mat of the present invention.

As shown in FIG. 1, a doormat generally designated by the reference numeral 1 has a substantially rectangular outline with rounded corners and comprises a basic material generally designated by the reference numeral 2 having a fibrous structure and bristles generally designated by the reference numeral 3 inserted therein. On the back of mat 1 can be fitted a reinforcing and optionally also slip-inhibiting substrate 4, but this does not form part of the present invention. The bristles 3 can be reciprocally arranged with a random geometry and the distribution thereof on the mat surface can also be of a random nature. FIG. 1 shows in exemplified manner individual, circular bristle bundles 5, crosswise-arranged bristle strips 6 and linear bristle strips 7. A mat can be covered with bristles of the same or different configurations.

As shown in FIGS. 2–5, the basic material 2 comprises a fibrous layer 8, mainly of tangled fibres and a support layer 9 fixing the back thereof. The support layer 9 can be produced by compressing fibres and applying a binder, by melting the fibres or by applying a foil-like cover coating or the like. The fibrous layer 8 is zonally melted by heated moulds and is compressed onto the support layer 9, so that depressions 10 form. The melted fibrous material and the support layer 9 form a reinforced base 11 at the bottom of the depression 10. Bristles 12, mainly parallel to one another, are inserted in the depression 10 after having previously been melted at their ends 13. With the melted ends 13, they are engaged on the optionally also melted reinforced base 11. If the materials used for fibrous layer 8 and bristles 12 are weldable, a homogeneous welded joint is formed on base 11. In the embodiment shown in FIG. 2, the bristles 12 project above the fibrous layer surface 14.

Figure 3:
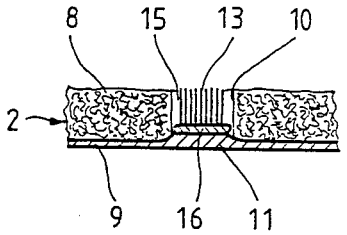

FIG. 3 shows a modified embodiment, in which once again the fibres are zonally melted, accompanied by the formation of a depression 10 and are compressed on the support layer 9. However, in this embodiment depression 10 has a somewhat larger cross-section than is assumed by bristles 12, so that an annular space 15 is formed, which can act as a dirt chamber. In this embodiment, the bristles 12 also terminate roughly flush with the fibrous layer surface 14 of fibrous layer 8. On the end of the bristles 12 remote from the useful surface thereof, is once again melted and compressed onto the bottom of depression 10, so that the melt forms a type of foot 16, which is optionally welded to base 11, but is at least stuck thereto by melting.

Figure 4:
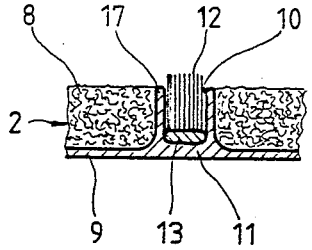
Figure 5:
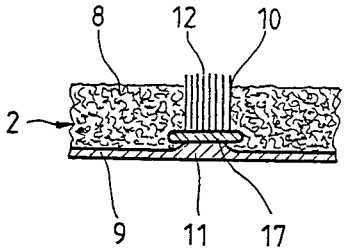

In the embodiment according to FIG. 4, fibrous layer 8 is melted not only for forming the reinforced base 11, but also laterally of the depression, so that a type of sleeve 17 is formed, which laterally guides the inserted bristles 12. Here again by melting their ends 13, bristles 12 are anchored to the bottom of depression 10 in the vicinity of base 11.

In the embodiment according to FIG. 5 in which once again the reinforced base 11 is produced by melting and compressing the fibres of fibrous layer 8, a bristle bundle 12 with melted end is again inserted in the resulting depression 10 and is compressed onto the reinforced base 11. Therefore the melt is displaced outwards, so that once again a foot 18 is formed. Unlike in the previously described embodiments, the melt in this case penetrates the fibres of fibrous layer 8, so that the bristles 12 are additionally anchored in fibrous layer 8 by means of foot 18.

I claim:

1. Mat for covering surfaces, the mat comprising a basic material mainly of plastic with a fibrous layer and a supporting layer fixing the latter, and having a bristle-like structure applied to the basic material, a plurality of spaced zonal depressions formed in the fibrous layer, a bottom portion is formed in each of the depressions by melting the fibrous layer and compressing the same at least one of onto and into the support layer, and wherein the bristles are placed in the respective depressions substantially in parallel to one another and joined to a bottom of the respective depressions.

2. Mat according to claim 1, wherein weld means are provided for joining the bristles to the basic material on the bottom of the respective depressions.

3. Mat according to one of claims 1 or 2, further comprising a widened foot provided on the ends of the bristles inserted in the respective depressions.

4. Mat according to claim 3, wherein the widened foot of the bristles extends up to the fibres of the fibrous layer adjacent to the respective depressions.

5. Mat according to one of claims 1 or 2, wherein the depressions include wall-like reinforcements formed by the fibres melted over a height of the fibrous layer.

6. Mat according to one of claims 1 or 2, wherein a cross-section assumed by the bristles is less than a cross-section of the respective depressions.

7. Mat according to one of claims 1 or 2, wherein a cross-section of the respective depressions is less than a cross section of the bristles.

8. Mat according to one of claims 1 or 2, wherein the bristles are inserted in the respective depressions by one of individually standing, in bundles or in strips.

9. Mat according to one of claims 1 or 2, wherein the bristles project over a surface of the fibrous layer and terminate one of flush or below the surface.

10. Mat according to claim 1, further comprising a reinforced base portion forming a bottom of the respective depressions for supporting inserted ends of the bristles in the respective depressions.

11. Mat according to claim 10, further comprising an annular space formed around a peripheral portion of a plurality of bristles inserted in the depressions so as to define a dirt accumulating chamber for the respective depressions.

12. Mat according to claim 10, further comprising a sleeve portion surrounding an outer periphery of a plurality of bristles inserted in the respective depressions, said sleeve portion extending from the reinforced base portion to an upper surface of the fibres of the fibrous layers adjacent the respective depressions.

13. Process for producing mats for covering surfaces, the mats comprising a basic material mainly of plastic with a fibrous layer and a support layer fixing the latter, and fibres with a bristle-like structure applied to the basic material, the process comprising the steps of zonally melting the basic material by heating the fibres of the fibrous layer, compressing the zonally melted fibrous layer at least one of onto and into the support layer to form a plurality of depressions in the fibrous layer, inserting the bristles into the respective depressions substantially in parallel to each other, and joining ends of the bristles to at least one of the compressed basic material and the support layer.

14. Process according to claim 13, wherein the step of joining includes forming a homogeneous weld between ends of bristles and a bottom portion of the depressions.

15. Process according to one of claims 13 or 14, wherein the step of joining includes melting ends of the bristles and compressing the melted ends onto the basic material in such a way that the melt of the bristles at least partly penetrates between fibres of the fibrous material adjacent to the respective depressions.

16. Process according to one of claims 13 or 14, further comprising the step of melting an edge region of the fibrous layer of the fibres of the basic material in an area of the depressions over a height of the fibrous layer for forming a wall.

17. Process according to claim 16, wherein the mat is produced as one of a web and a plurality of area-bounded section.

18. Process according to claim 13, wherein the step of zonally melting includes applying heat molds to the fibrous layer and compressing the fibrous layer thereby to form the depressions.

19. Process according to claim 18, further comprising the step of forming a reinforced base portion at a bottom of the respective depressions.

20. Process according to one of claims 18 or 19, wherein the step of joining includes heating ends of the bristle prior to inserting the bristles into respective depressions so as to engage the reinforced bottom portion.

21. Process according to claim 19, wherein the step of joining includes forming a homogeneous weld between ends of the bristles and the base portion of the bottom portion of the respective depressions.

22. Process according to one of claims 18 or 19, wherein the bristles have a length greater than an axial length of the respective depressions whereby an upper end of the bristles terminate above an upper end surface layer of the fibrous surface layer when the bristles are inserted in the depressions.

23. Process according to one of claims 18 or 19, wherein the bristles have an axial length less than an axial length of the respective depressions whereby upper ends of the bristles terminate at a distance below an upper end surface of the fibrous layer when the bristles are inserted in the respective depressions.

24. Process according to one of claims 18 or 19, wherein the step of zonally melting includes heating the fibres of the fibrous layer and the support layer.

* * * * *